US006736061B2

(12) United States Patent
Caunter et al.

(10) Patent No.: US 6,736,061 B2
(45) Date of Patent: May 18, 2004

(54) ROTARY SIGNATURE TRANSFER DEVICE

(75) Inventors: Nicholas J. Caunter, Portsmouth, NH (US); Kevin Krieg, Mason, OH (US); Richard D. Wamsley, Dover, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/155,104

(22) Filed: May 24, 2002

(65) Prior Publication Data

US 2003/0217656 A1 Nov. 27, 2003

(51) Int. Cl.[7] ..... B41F 13/56

(52) U.S. Cl. ..... 101/227; 101/227; 101/228; 101/231; 101/232

(58) Field of Search ..... 101/227, 232, 101/480, 365, 408, 409, 231, 228; 198/644, 369

(56) References Cited

U.S. PATENT DOCUMENTS 3,796,422 A * 3/1974 Blowsky ..... 270/58.21
4,240,346 A * 12/1980 Landis et al. ..... 101/139
4,452,544 A * 6/1984 Sumita ..... 401/53
4,471,955 A * 9/1984 Bradley et al. ..... 271/203
4,482,141 A * 11/1984 Moser ..... 198/644
5,447,302 A * 9/1995 Curley ..... 271/277
5,595,119 A 1/1997 Hada et al. ..... 101/477
2001/0032774 A1 10/2001 Aesch ..... 198/644

FOREIGN PATENT DOCUMENTS

EP 0771675 5/1997

* cited by examiner

*Primary Examiner*—Andrew H. Hirshfeld
*Assistant Examiner*—Marissa Ferguson
(74) *Attorney, Agent, or Firm*—Davidson, Davidson & Kappel, LLC

(57) ABSTRACT

A signature transfer device includes a rotating arm rotating about a first axis and a first gripper rotatably mounted on the rotating arm about a second axis, the first and second axes being parallel, the first gripper having a first gripper finger and a second gripper finger. An actuator is connected to the first gripper for opening and closing the first gripper as a function of the angle of the rotating arm about the first axis, and a compression spring connects the first gripper finger and the second gripper finger, the compression spring being compressed when the first gripper and the second gripper finger are apart.

13 Claims, 5 Drawing Sheets

ROTARY SIGNATURE TRANSFER DEVICE

BACKGROUND OF THE INVENTION

The present invention relates generally to printing presses and more particularly to a signature transfer device for transporting printed products.

A web printing press, for example for newspapers, will print a continuous web of material. In a folder of the printing press, the web will be folded, if desired, and then cut, so that signatures result. The signatures can then be conveyed on a conveyor and then transferred by a signature transfer device to another conveyor for further processing or delivery.

U.S. Pat. No. 4,482,141 discloses a method and device for conveying signatures from a blade chain conveyor supporting the signatures directly at a fold line. The signatures are gripped from above by orbitally-rotating clamping pads, which then transfer the signatures to a belt conveyor perpendicular to the blade chain conveyor. A tension spring forces the gripper fingers together. This patent is hereby incorporated by reference herein.

European Patent Application No. 0771 675 A1 discloses a device for removing signatures from a saddle conveyor supporting the signatures. The conveyor has cutouts that permit the signatures to be gripped from above by a rotating clamping device, which then further conveys the signatures to a belt conveyor.

U.S. patent application No. 2001/00327741 discloses a device for removing signatures from a saddle conveyor that moves the signatures over cutouts in a sword. Grippers grip the outside of the signature from above and transfer the signatures to a further conveying device.

SUMMARY OF THE INVENTION

An object of the present invention is to permit efficient removal of signatures and transfer from a conveyor.

The present invention provides a signature transfer device comprising: a rotating arm rotating about a first axis; a first gripper rotatably mounted on the rotating arm about a second axis, the first and second axes being parallel, the first gripper having a first gripper finger and a second gripper finger; an actuator connected to the first gripper for opening and closing the first gripper as a function of the angle of the rotating arm about the first axis; and a compression spring connecting the first gripper finger and the second gripper finger, the compression spring being compressed when the first gripper and the second gripper finger are apart.

By using a compression spring, various signature thicknesses can be accommodated without the need for control elements. As the signature thickness increases, the spring force increases since the compression spring is further compressed. Complicated signature thickness adjustments are not necessary. Preferably, the signature thicknesses range between 0 and 2.5 cm.

Preferably, the actuator is a cam follower interacting with a cam on the arm.

Preferably, the signature transfer device includes a second gripper rotating about the axis. The first and second grippers may be supported rotatably on a rotating arm rotating about the axis.

Preferably, the compression spring is compressed less than 10% of its uncompressed length when the first gripper finger and second gripper finger are closed without holding a signature. The spring can thus be changed without danger of the compression spring provided too much force during the changing operation.

The first gripper finger preferably includes a support rod extending through the second gripper finger, the support rod supporting the compression spring.

The first gripper preferably includes a support, the first and second gripper fingers and the cam follower being rotatable with respect to the support. The first and second gripper fingers may be geared together, and the cam follower may rotate one of the gears.

The support rod preferably has a removable nut at one end to support one end of the compression spring. The other end of the spring preferably is supported by the support, the spring thus being indirectly connected to the second gripper finger via the support.

The spring preferably extends through the rotating arm, and may be surrounded by the support. A first pulley may be fixed to an outer surface of the support, the support and the first pulley thus being rotatable with respect to the arm, which may house the support at a bearing surface.

The arm preferably is rotated via a central shaft. A fixed pulley preferably surrounds the central shaft, and is connected for example to a frame of a printing press or to the ground, so that the central shaft rotates with respect to the fixed pulley. A first belt preferably runs between the fixed pulley and the first pulley, so that as the arm rotates, the first belt causes the first gripper to maintain its orientation. A second pulley may be attached to the second gripper and, through a second belt, to the fixed pulley.

The present invention also provides a printing press comprising a print unit for printing a material, a conveyor for moving a plurality of signatures formed from the material in a first direction, and a signature transfer device for transferring signatures downstream of the conveyor. The signature transfer device has a rotating arm rotating about a first axis and a first gripper rotatably mounted on the rotating arm about a second axis, the first and second axes being parallel, the first gripper having a first gripper finger and a second gripper finger; an actuator connected to the first gripper for opening and closing the first gripper as a function of the angle of the rotating arm about the first axis; and a compression spring connecting the first gripper finger and the second gripper finger, the compression spring being compressed when the first gripper and the second gripper finger are apart.

Preferably, the printing press is a web printing press, and further includes a folder for forming signatures from the web.

A signature lifting device can be provided to lift the signatures from the conveyor, or the signatures can be transferred directly from the conveyor.

"Gripper finger" as defined herein is any gripper part used to contact a signature.

BRIEF DESCRIPTION OF THE DRAWINGS

The following figures show a preferred embodiment of the present invention in which.

DETAILED DESCRIPTION OF A PREFERRED EMBODIMENT

Figure 1:
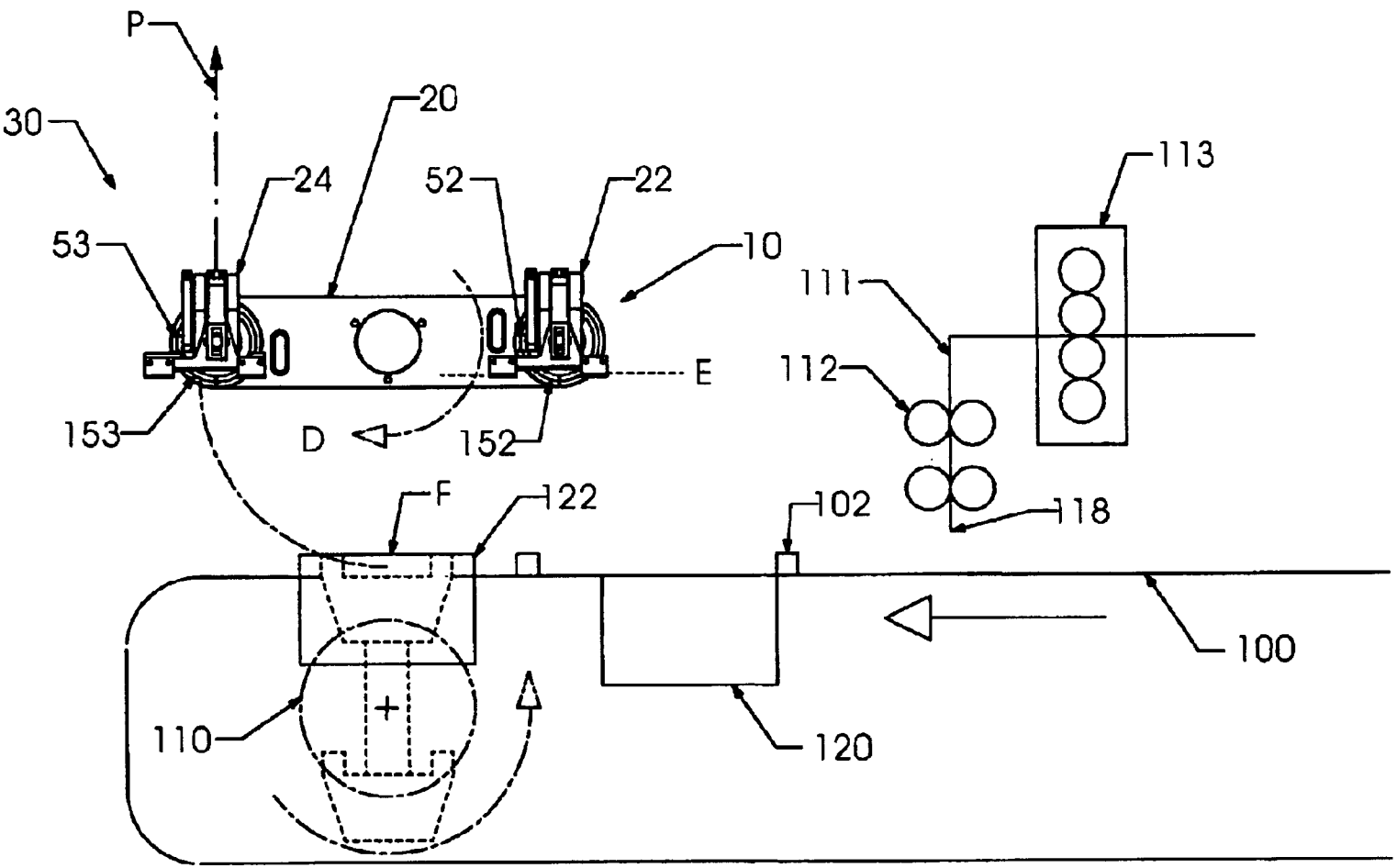
FIG. 1 shows a schematic side view of the printing press of the present invention.

FIG. 1 shows a preferred exemplary embodiment of a web lithographic offset printing press according to the present invention having a print unit 113 printing a web 111, which is then folded, if desired, and cut into signatures 118, 120, 122 in a folder 112. The signatures are conveyed on a saddle conveyor 100 with a fold F of the signature being between two chains of the conveyor. Pushers 102 on the chains aid in moving the signatures.

The signatures may be lifted from the chain by a signature lifting device 110 passing between the chains and lifting the signature from below at the fold. Alternately, the signatures may be lifted directly from conveyor 100 or from a sword.

Signature transfer device 30 can then lift the signatures using grippers 22, 24 rotatingly mounted on a rotating arm 20, which rotates in a direction D. Grippers 22 and 24 rotate with respect to arm 20 so as to maintain a similar orientation, i.e. so that gripper edge E remains parallel to fold F or a direction of movement of conveyor 100. Thus as signature 122 is lifted, one of the grippers 22, 24 grips the fold F from the outside and transports the signature along transfer path P.

The opening and closing of the grippers 22, 24 is controlled by cam followers 52, 53, respectively, running in cams 52, 53 fixed to arm 20. If the gripper 22 is considered to be at a 3 o'clock position, and gripper 24 at a 9 o'clock position, the cam activates the grippers 22, 24 to close at the 6 o'clock position to grip the signatures, and then to open again at the 9 o'clock position to release the signatures to a further conveying device, such as a set of tapes.

Figure 2:
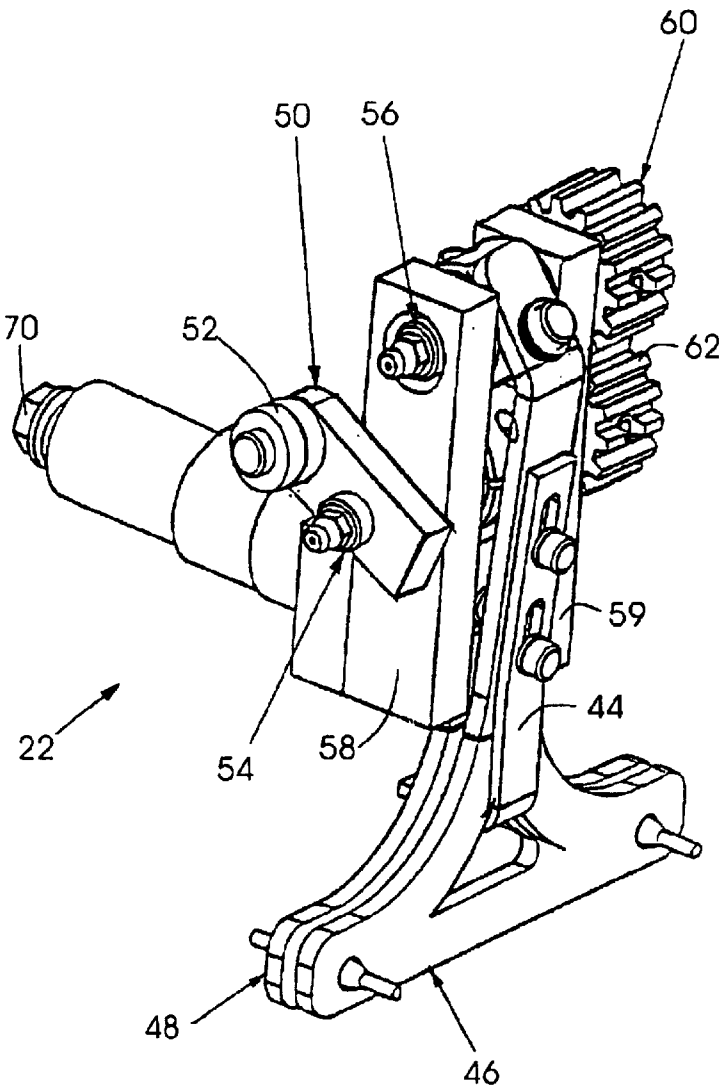
FIG. 2 shows a perspective view of the one of the grippers of the signature transfer device of the present invention.
Figure 3:
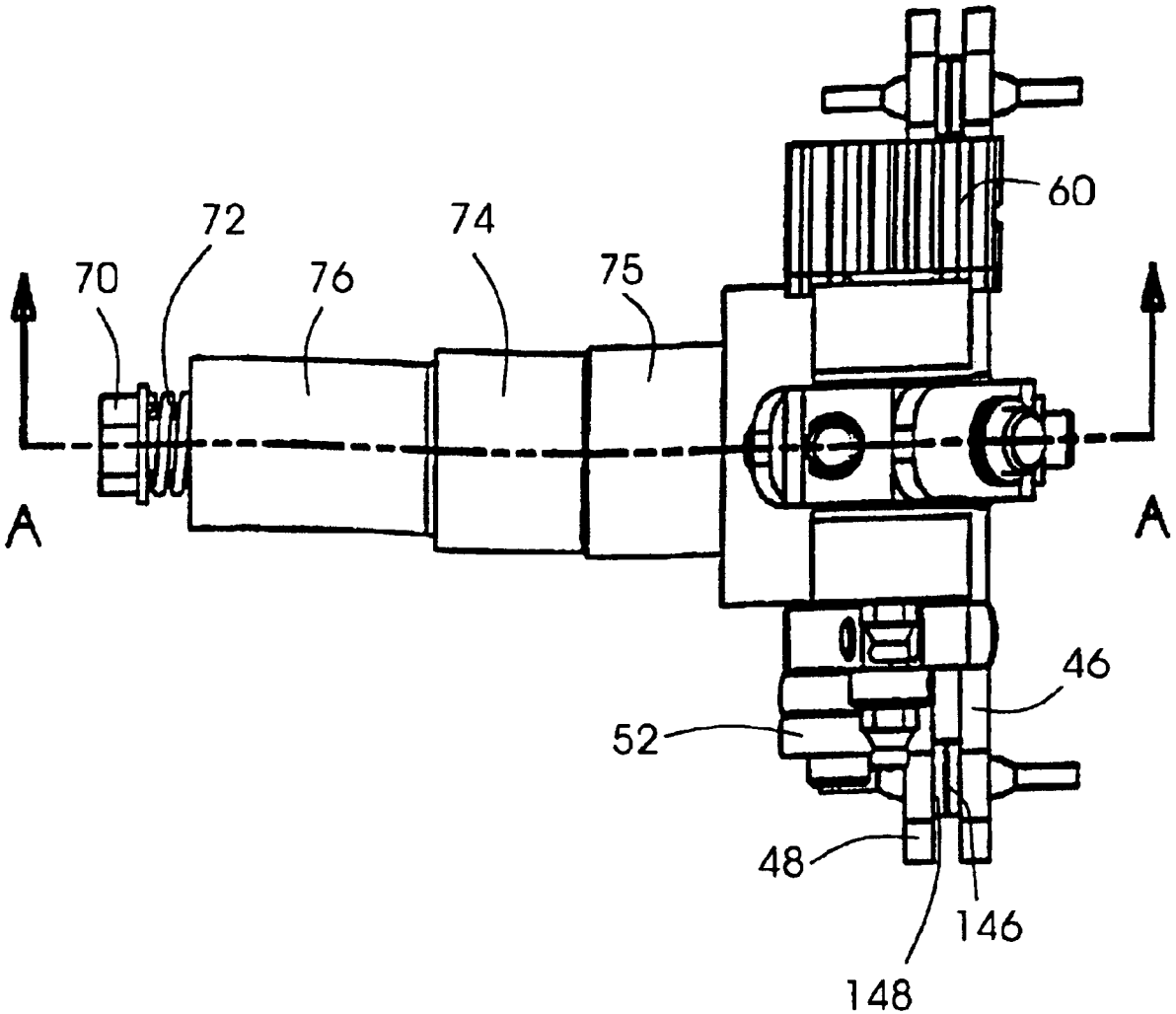
FIG. 3 shows a top view of the FIG. 2 gripper.
Figure 4:
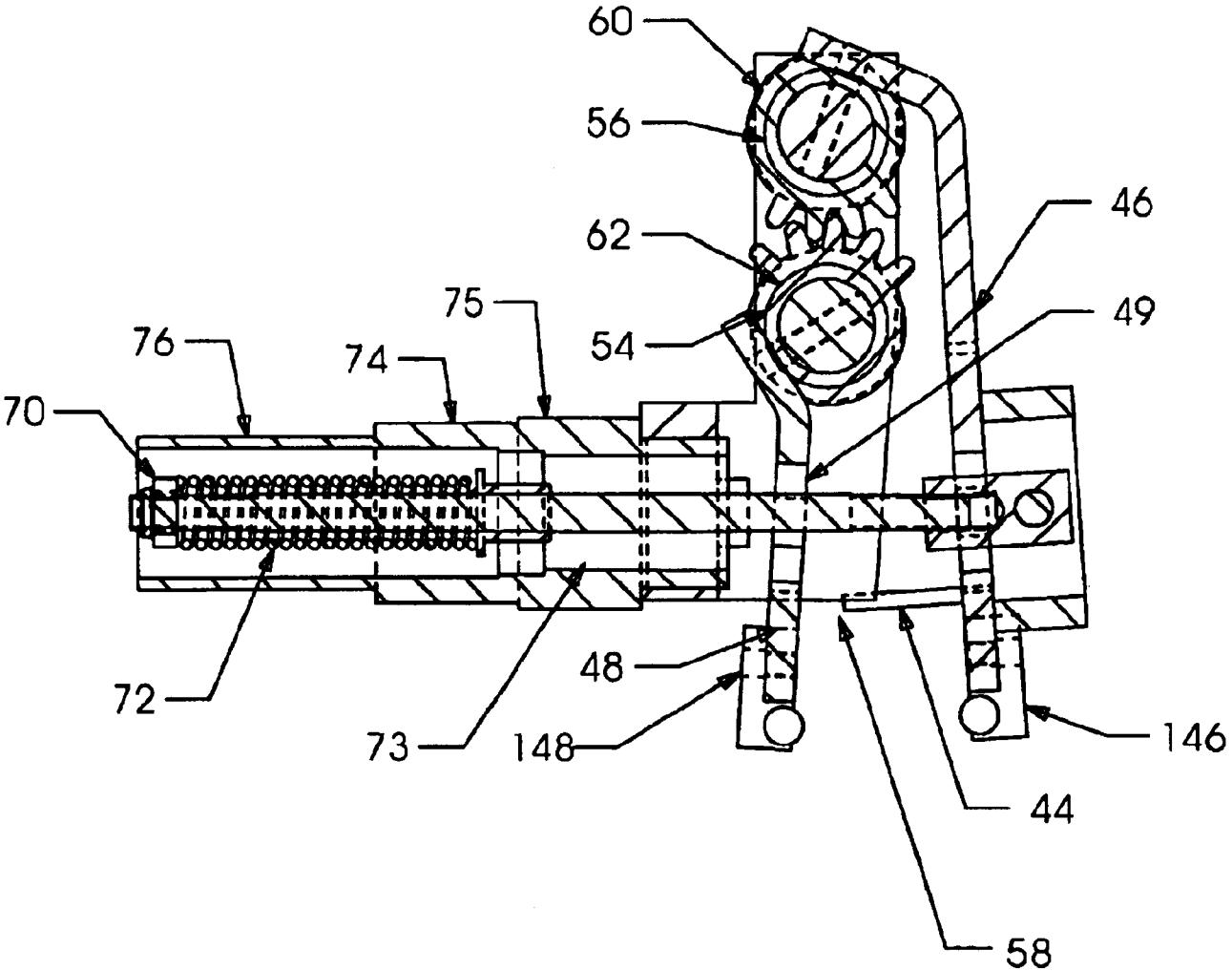
FIG. 4 shows a view of the gripper through section A—A shown in FIG. 3.

FIGS. 2, 3 and 4 show more details of one of the grippers 22, the gripper 24 being substantially similar to gripper 22. Gripper 22 has two gripper fingers 46, 48 rotatably supported in supports 58, 59 by shafts 56, 54, respectively, as shown best in FIG. 4. Shafts 56, 54 are fixed to gears 60, 62 respectively, which are in turn geared together.

Attached to outer finger 46 is a settable fold stop 44, which passes through finger 48 to ensure that the signature does not pass to high into the gripper 22. The gripper fingers 46, 48 also may have gripper pads 146, 148, respectively.

Fixed to outer gripper finger 46 is a support rod 73, having a removable nut 70 at a free end. Rod 73 passes through inner gripper finger 48 at an aperture 49. Rod 73 supports a linear compression spring 72, which contacts the nut 70 at one end and support 58 at another end. Support 58 also includes a housing 76 surrounding spring 72.

Support 76 has a first outer surface section 74 and a second outer surface section 75.

Figure 5:
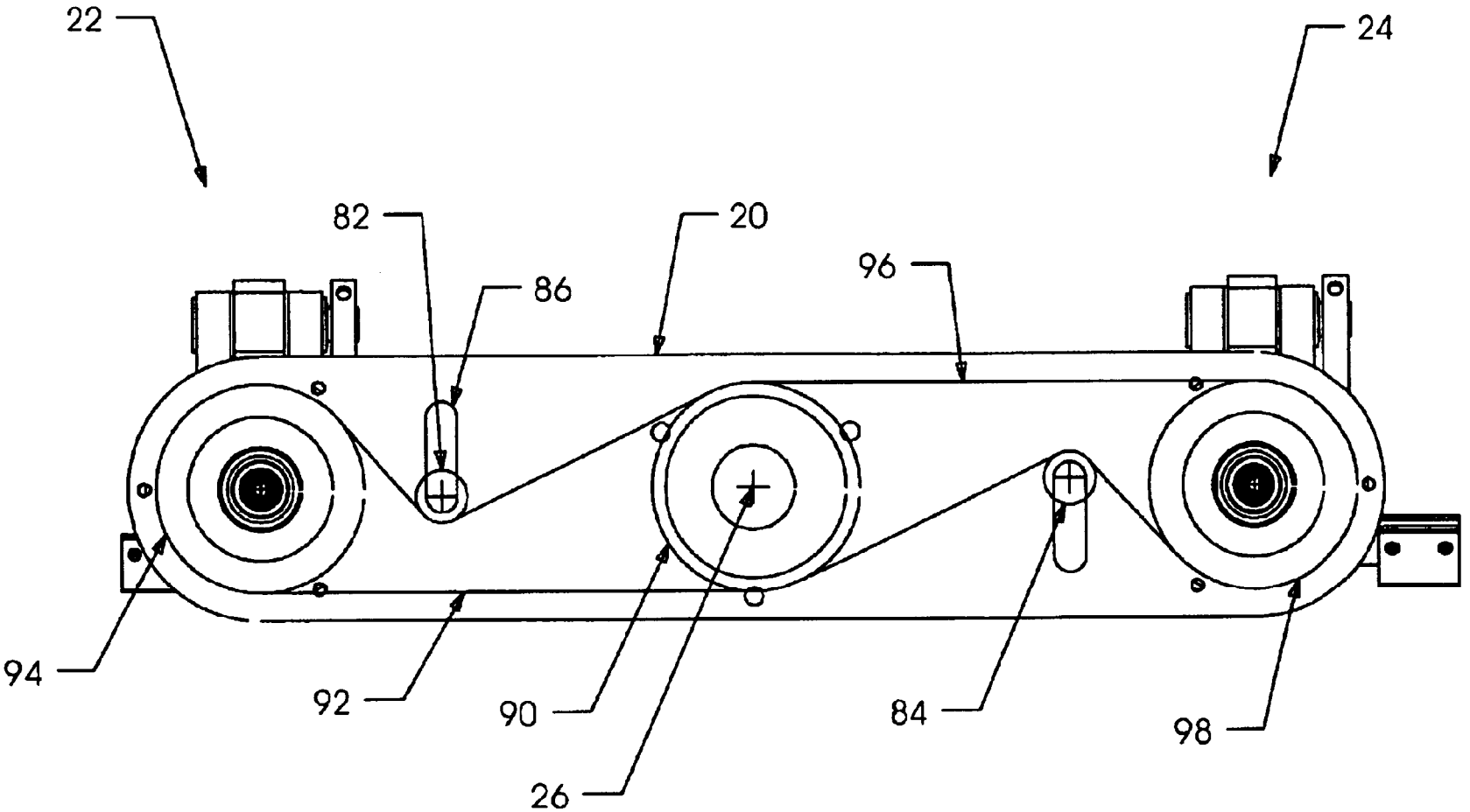
FIG. 5 shows a rear view of the signature transfer device according to the present invention.

As shown in FIG. 5, rotating arm 20 supports gripper 22 at one end and gripper 24 at another end. Gripper 22 is rotatingly supported in arm 20, with support 76 passing through a hole in arm 20, and second outer surface section 75 (FIG. 4) interacting with a bearing in the hole of arm 20. A pulley 94 is fixed to first outer surface section 74 of support 76. Pulley 94 has a toothed outer section, over which a belt 92 runs, with belt 92 interacting as well with a fixed pulley 90.

Pulley 94, and gripper 22 thus rotate together, and as arm 20 is rotated by central shaft 26, belt 92 causes pulley 94 to rotate so as to preserve the orientation of gripper 22. In other words, gripper edge E remains parallel to fold edge F as arm 20 rotates in direction D.

In order to control a tension on belt 92, an adjustment roller 82 can be slid against a smooth outer surface of belt 92. Adjustment roller 92 can move in slot 86 in arm 20 and be connected rotatably to arm 20.

Fixed pulley 90 has two toothed sections, one interacting with belt 92, and another interacting with a second toothed belt 96, which is connected to a second pulley 98 connected at another end of arm 20.

Second pulley 98 is fixedly connected to gripper 24, and both gripper 24 and pulley 98 can rotate with respect to arm 20, so that as arm 20 rotates, gripper 24 maintains its orientation, preferably so that the gripper edge remains horizontal.

An adjustment roller 84 can set the tension of belt 96.

More than two grippers are also possible by replacing two-legged arm 26 with a three or more legged arm. "Signature" as defined herein can include single sheet or multi-sheet printed product. "Arm" as defined herein is any rotating support structure.

What is claimed is:

1. A signature transfer device comprising:

a rotating arm rotating about a first axis;

a first gripper rotatably mounted on the rotating arm about a second axis, the first and second axes being parallel, the first gripper having a first gripper finger and a second gripper finger;

an actuator connected to the first gripper for opening and closing the first gripper as a function of the angle of the rotating arm about the first axis; and a linear compression spring connecting the first gripper finger and the second gripper finger, the compression spring being compressed when the first gripper and the second gripper finger are apart;

the first gripper finger including a support rod extending through the second gripper finger, the support rod supporting the compression spring.

2. The signature transfer device as recited in claim 1 wherein the actuator is a cam follower interacting with a cam on the arm.

3. The signature transfer device as recited in claim 1 further including a second gripper rotating about the first axis.

4. The signature transfer device as recited in claim 3 wherein the first and second grippers are supported rotatably on the a rotating arm rotating about the first axis.

5. The signature transfer device as recited in claim 1 wherein the compression spring is compressed less than 10% of an uncompressed length when the first gripper is closed without a signature.

6. The signature transfer device as recited in claim 1 wherein the first gripper includes a support, the first and second gripper fingers and the cam being rotatable with respect to the support.

7. The signature transfer device as recited in claim 6 wherein the first and second gripper fingers are geared together.

8. The signature transfer device as recited in claim 1 wherein the support rod has a removable nut at one end to support one end of the compression spring.

9. The signature transfer device as recited in claim 6 wherein the spring extends through the rotating arm.

10. The signature transfer device as recited in claim 1 further comprising a first pulley fixed to the first gripper and rotatable with respect to the arm, a fixed pulley, and a belt connecting the first pulley and the fixed pulley.

11. The signature transfer device as recited in claim 1 wherein the fixed pulley surrounds a central shaft driving the arm.

12. A printing press comprising:

a print unit for printing a material, a conveyor for moving a plurality of signatures formed from the material in a first direction, and a signature transfer device for transferring signatures downstream of the conveyor, the signature transfer device having a rotating arm rotating about a first axis and a first gripper rotatably mounted on the rotating arm about a second axis, the first and second axes being parallel, the first gripper having a first gripper finger and a second gripper finger, an actuator connected to the first gripper for opening and closing the first gripper as a function of the angle of the rotating arm about the first axis, and a linear compression spring connecting the first gripper finger and the second gripper finger, the compression spring being compressed when the first gripper and the second gripper finger are apart; the first gripper finger including a support rod extending through the second gripper finger, the support rod supporting the compression spring.

13. The printing press as recited in claim 12 wherein the printing press is a web printing press, and further including a folder for forming signatures from the web.

* * * * *